US005750307A

United States Patent [19]

Maher et al.

[11] Patent Number: 5,750,307

[45] Date of Patent: May 12, 1998

[54] PHOTOCONDUCTOR CLEANING BRUSH TO PREVENT FORMATION OF PHOTOCONDUCTOR SCUM

[75] Inventors: James C. Maher, North Rose; Dinesh Tyagi, Fairport; John R. Locke, Spencerport, all of N.Y.

[73] Assignee: Eastman Kodak Company, Rochester, N.Y.

[21] Appl. No.: 753,866

[22] Filed: Dec. 3, 1996

[51] Int. Cl.[6] ..... G03G 15/095

[52] U.S. Cl. ..... 430/125; 399/353; 15/207.2

[58] Field of Search ..... 355/354; 430/123; 399/353; 15/207.2

[56] References Cited

U.S. PATENT DOCUMENTS

| | | | |
|---|---|---|---|
| 4,213,794 | 7/1980 | Wooding et al. . | |
| 4,506,975 | 3/1985 | Shukuri et al. | 430/123 |
| 4,847,175 | 7/1989 | Pavlisko et al. | 430/58 |
| 4,903,084 | 2/1990 | Baltrus | 355/301 |
| 5,240,802 | 8/1993 | Molaire et al. | 430/67 |
| 5,508,879 | 4/1996 | Kitamura et al. | 361/221 |

*Primary Examiner*—John Goodrow
*Attorney, Agent, or Firm*—John R. Everett

[57] ABSTRACT

A brush having synthetic fibers that are inert to paper fillers is disclosed. The brush is effective in preventing scumming on photoconductive elements.

2 Claims, No Drawings

PHOTOCONDUCTOR CLEANING BRUSH TO PREVENT FORMATION OF PHOTOCONDUCTOR SCUM

FIELD OF THE INVENTION

The present invention relates to electrostatography.

BACKGROUND OF THE INVENTION

In a typical xerographic process, a photoconductive element is initially uniformly charged by such means as a corona or roller charger. The photoconductive element is then image-wise exposed to light, thereby producing an electrostatic latent image. The latent image is then developed into a visible image by passing the photoconductive element over a development station containing electrically charged toner particles.

Typically, the development station consists of a core containing magnets which rotate thereby bringing the developer comprised of a mixture of toning and carrier particles into contact with the electrostatic latent image. The visible image is then transferred to a receiver sheet, typically paper, using any appropriate means such as by application of an appropriate electrostatic field using either an electrically biased roller or a corona. The visible image is then permanently fixed to the receiver by suitable means such as fusing.

In a typical electrophotographic operation, the amount of toner transferred from the photoconductive element surface to the receiver sheet is far from complete. In order to prepare the photoconductive element for subsequent imaging, the photoconductive element must first be cleaned of residual material.

Many approaches have been proposed to remove residual toner particles from photoconductive elements. A method of cleaning the photoconductive surface with a rotating fur brush cleaner is described in U.S. Pat. No. 4,903,084.

The rotating cleaning brush is generally made with synthetic fibers such as acrylic, polyester, nylon, dacron or the like. The brushes are mounted in a cleaning subsystem of electrophotographic copiers. Such fibers are commercially available and are produced for use in a variety of products, unrelated to their use in electrophotography, and their composition is optimized for their production. Synthetic fiber brushes, particularly made of acrylic fibers, have been used in electrophotographic copying machines for decades.

When residual toner is removed from the photoconductive element after the image transfer step with the aid of a rotating fur brush, a scum is usually observed on the photoconductive element.

SUMMARY OF THE INVENTION

The present invention provides a brush having synthetic fibers that are inert to paper fillers.

The present invention also provides a method of preventing scum from forming on a photoconductive element comprising the step of brushing the element with a brush having fibers that are inert to paper fillers.

In electrophotographic equipment using the above described brush in a brush cleaning subsystem of the equipment scumming is substantially reduced or eliminated. The polymer finish on the brush fibers prevent the fibers from interacting with paper filler residues.

DETAILS OF THE INVENTION

It has been found that photoconductor scum is due to the presence of clusters of small particles (each particle typically less than 1 μm diameter) adhering to the photoconductor. These clusters comprise paper fillers and low yield strength, low surface energy wax materials. The paper fillers include calcium carbonate, aluminum silicate and other additives used in manufacture of paper. The waxes are present in cleaning brush fibers. The paper filler and the fiber waxes are deposited as clusters on the photoconductive element when the cleaning brush is brought into contact with the photoconductive element.

Synthetic fiber brushes, particularly those made of acrylic fibers are often used in the cleaning brushes used in electrophotographic elements. Fibers labeled as "acrylic" need contain only 85% of material chemically identified as acrylonitrile. The other 15% is usually comprised of other proprietary addenda and is added to the fibers during their production for ease of production, finishing, etc. These addenda are proprietary and, being directly incorporated into the manufacturing process of the synthetic fibers, are inherently present when anyone purchases the fibers from the fiber manufacturers.

We found that small amounts of low yield strength material having low surface energies (less than 40 ergs/cm$^2$) are added to the synthetic fibers to facilitate production. By "low yield strength, low surface energy material" we mean materials such as waxes, fatty acids such as stearic acid fatty amides such as steramide and ethylene bis-steramide, aliphatic hydrocarbons, and esters and salts of fatty acids.

A wide variety of polymers that are inert to paper fillers are available and can be used to coat brush fibers formed from the above described synthetic fibers. According to the inventions, these polymers can be coated on the brush fibers by spray coating, dip coating, and melt extrusion coating. The solvent used for coating the fibers must be inert relative to the brush fibers.

The types of polymers that are suitable for coating the brush fibers have high yield strength (Young's Modulus greater than 5 MPa). Since these polymers must provide a solid barrier between the fiber finish and paper fillers, the polymers must have at least one thermal transition above 50° C. The polymers must be coatable by various coating processes such as spray, dip or melt coating. Finally the polymers must adhere sufficiently to the brush fibers to provide the desired barrier between brush fibers and paper fillers.

Most of these requirements are met by a number of homopolymers and copolymers. The examples of such suitable polymers which can be used if they are found to have characteristics as indicated above include, for example, olefin homopolymers and copolymers, such as polyethylene, polypropylene, polyisobutylene. polyisopentylene, and the like; polyfluoroolefins, such as polytetranuoroethylene; polyamides, such as polyhexamethylene adipamide, polyhexamethylene sebacamide and polycaprolactam, and the like; acrylic resins, such as polymethylmethacrylate, polyacrylonitrile, polymethylacrylate, polyethylmethacrylate styrene-methylmethacrylate copolymers, ethylene-methyl acrylate copolymers, ethylene-ethyl acrylate copolymers, ethylene-ethyl methacrylate copolymers, and the like; polystyrene and copolymers of styrene with unsaturated monomers, cellulose derivatives, such as cellulose acetate, cellulose acetate butyrate, cellulose propionate, cellulose acetate propionate, ethyl cellulose and the like; polyesters; polycarbonates; polyvinyl resins, such as polyvinyl formal, polyvinyl chloride, copolymers of vinyl chloride and vinyl acetate, polyvinyl butyral, polyvinyl alcohol, polyvinyl acetal, ethylene-vinyl acetate copolymers, ethylene-vinyl alcohol copolymers, and the like; allyl polymers, such as ethylene-allyl copolymers, ethylene-allyl alcohol copolymers, ethylene-allyl acetone copolymers, ethylene-allyl benzene copolymers, ethylene-allyl ether copolymers, and the like; ethylene-acrylic copolymers; polyoxymethylene; and various polycondensation polymers, such as polyurethanes, polyamides, and the like; and mixtures thereof. Presently preferred are condensation polyesters.

For spray coating or solution coating processes, various organic solvents can be used. Examples of useful organic solvents that preferably dissolve the polymer include, for example, chloromethane, di-chloromethane, ethyl acetate, propyl acetate, vinyl chloride, methyl ethyl ketone, trichloromethane, carbon tetrachloride, tetrahydrofuran, ethylene chloride, trichlorethane, toluene, xylene, cyclohexanone, 2-nitropropane, mixtures thereof, and the like. A particularly useful carrier liquid is ethyl acetate or dichloromethane because they are good solvents for many polymers while at the same time they are immiscible with water. Further, their volatility is such that they can be readily removed from the discontinuous phase droplets by evaporation during coating operation.

In use the brushes are configured for operation in fur brush cleaning subsystems in electrophotographic imaging equipment. Such equipment and subsystems are illustrated in U.S. Pat. No. 4,903,084. Methods for configuring the brushes and installing them in such equipment are well known as illustrated by the foregoing patent literature.

In the following examples cleaning brushes were made using a commercially available acrylic fiber produced and sold by Monsanto for a variety of applications. These fibers normally contain at least 0.5% by weight on average of an ester of a fatty acid and are typical of the fibers produced by the fiber industry. These fibers were woven into a mat similar to a pile lining in a coat and then cut and wound around and permanently fixed to a fiber core using glue. Scumming performance was determined by running the brush against a photoconductive element in a Kodak 2100 copier through which paper was run for the equivalent of between 5,000 and 20,000 copies. The tendency of scum to form was determined directly by observing the photoconductive element.

The invention is further clarified in the following examples.

COMPARATIVE EXAMPLE 1

A fresh, as received, rotating cleaning fur brush was installed in a Kodak 2100 copier which contained a fresh photoconductor belt. After 5,000 blank sheets of paper were fed through the copier, the copier was stopped and the photoconductor belt was taken out and examined. The presence of scum was observed on the photoconductor belt. The location of the scum on the photoconductor belt coincided with the observation of the image background prior to the stoppage of the copier. It is known that the increase in the charge retention at photoconductor surface leads to the above mentioned image artifacts.

EXAMPLE 1

A 5% solution weight to volume of 80 weight percent styrene and 20 weight percent butyl acrylate copolymer sold as Piccotoner 1278 (Hercules-Sanyo Inc.) was prepared in ethyl acetate solvent. 30 ml of the solution was sprayed onto a cleaning roller using a laboratory atomizing sprayer. The roller was allowed to dry for 12 hours after which the scumming performance was evaluated by the method mentioned in the previous paragraph. There was no visible scum on the photoconductor after 20,000 equivalent prints running paper only.

EXAMPLE 2

A 5% solution weight to volume of a styrene and ethylene-propylene block copolymer sold as Kraton 1652G (Shell Chemical Company) was prepared in ethyl acetate solvent. 30 ml of this solution was also sprayed onto a cleaning roller and allowed to dry for 12 hours. The scumming performance was evaluated similar to Example 1 with the same result and no scum was observed.

EXAMPLE 3–4

Four differently polymer coated cleaning fur brushes were prepared as described in Example 1. The brushes and the polymer coatings are shown in Table 1 except a different polymeric binder were used at various solution concentrations. These Examples are described in Table 1 below.

TABLE 1

| | Barrier Polymer |
|---|---|
| Ex. 3 | poly vinyl formal |
| Ex. 4 | bis-phenol A polyester |

All of the above coated fiber brushes were evaluated similar to Example 1 for photoconductor scum and in all cases the surface of the photoconductor was found to be free of scum and image artifacts.

The invention has been described with particular reference to preferred embodiments thereof but it will be understood that variations and modifications can be effected within the spirit and scope of the invention.

We claim:

1. A brush having synthetic fibers coated with a polymer material; wherein the polymeric material has (a) a Young's Modulus greater than 5 MPa and at least one thermal transition above 50° C. and (b) is selected from the group consisting of:

(i) 80 weight percent styrene and 20 weight percent butyl acrylate, (ii) a block copolymer of styrene of styrene and ethylene propylene, (iii) poly vinyl formal and (iv) bis-phenol A polyester.

2. A method of preventing scum from forming on a photoconductive element during an electrophotographic imaging process, comprising the steps of:

electrostatically charging the photoconductive element;

image-wise exposing the element to light, thereby producing an electrostatic latent image;

developing the latent image with electrically charged toner particles;

transferring the developed image to a receiver and brushing the element with a brush having polymer coated synthetic fibers that are inert to paper fillers; wherein the polymers are selected from the group consisting of (a) 80 weight percent styrene and 20 weight percent butyl acrylate, (b) a block copolymer of styrene of styrene and ethylene propylene, (c) poly vinyl formal and (d) bis-phenol A polyester.

* * * * *